US009987548B2

(12) United States Patent
Davis

(10) Patent No.: US 9,987,548 B2
(45) Date of Patent: Jun. 5, 2018

(54) AUTOMATIC METHOD FOR APPLYING NON-SLIP TREATMENT TO PIN DECK OF A BOWLING LANE

(71) Applicant: Kegel, LLC, Lake Wales, FL (US)

(72) Inventor: Mark Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 228 days.

(21) Appl. No.: 14/748,860

(22) Filed: Jun. 24, 2015

(65) Prior Publication Data

US 2016/0375348 A1 Dec. 29, 2016

(51) Int. Cl.
*A63D 5/10* (2006.01)

(52) U.S. Cl.
CPC ..... *A63D 5/10* (2013.01)

(58) Field of Classification Search
CPC ..... A63D 5/10
See application file for complete search history.

(56) References Cited

U.S. PATENT DOCUMENTS 5,729,855 A * 3/1998 Davis ..... A47L 11/03 118/207
6,615,434 B1 9/2003 Davis et al.
6,939,404 B1 * 9/2005 Davis ..... A47L 11/145 118/207
7,056,384 B2 6/2006 Davis et al.
7,060,137 B2 * 6/2006 Davis ..... A47L 11/145 118/204
7,704,152 B1 4/2010 Thorson
8,122,563 B2 2/2012 Burkholder et al.
2005/0081782 A1 * 4/2005 Buckley ..... A47L 11/03 118/207
2005/0217700 A1 * 10/2005 Davis ..... A47L 11/145 134/10
2006/0107894 A1 * 5/2006 Buckley ..... A47L 11/03 118/207
2006/0278161 A1 * 12/2006 Burkholder ..... A47L 11/03 118/323
2007/0011838 A1 * 1/2007 Davis ..... A47L 11/19 15/230

(Continued)

OTHER PUBLICATIONS

Lawter Material Safety Data Sheet Snowtack(TM) 765A Tote 2775LB, Mar. 16, 2015, pp. 1-9.

*Primary Examiner* — Alexander Markoff
(74) *Attorney, Agent, or Firm* — Hovey Williams LLP

(57) ABSTRACT

A lane maintenance machine has a cleaning system that includes at least one liquid dispensing head that reciprocates back and forth transversely of the lane as the machine travels along the length of the lane. The dispensing head includes a dispensing tip therein that emits a pin deck treatment product and applies it to a pin deck. The system provides accurate, precise metering of the pin deck treatment liquid and affords board-by-board control of the dispensing action. A wiping assembly immediately behind the dispensing head provides a web of cloth-like material looped under a compressible backup roller to wipe or smear the applied liquid. In a preferred embodiment, the dispensing head is a double head, and it includes a second tip for dispensing a cleaning solution so that pin deck treatment can take place with the same piece of equipment, after lane cleaning has taken place, making the entire process automated.

10 Claims, 6 Drawing Sheets

(56) References Cited

U.S. PATENT DOCUMENTS

| | | | | |
|---|---|---|---|---|
| 2007/0289086 | A1* | 12/2007 | Davis | A63D 5/10 15/340.3 |
| 2010/0006028 | A1* | 1/2010 | Buckley | A47L 11/03 118/696 |
| 2011/0162156 | A1* | 7/2011 | Burkholder | A47L 11/03 15/97.1 |
| 2012/0011678 | A1* | 1/2012 | Davis | A63D 5/10 15/319 |
| 2012/0125378 | A1* | 5/2012 | Burkholder | A47L 11/03 134/117 |
| 2012/0192368 | A1* | 8/2012 | Recknagel | A47L 11/03 15/98 |
| 2014/0208529 | A1* | 7/2014 | Burkholder | A47L 11/03 15/50.1 |
| 2014/0208530 | A1* | 7/2014 | Recknagel | A47L 11/03 15/98 |
| 2014/0259479 | A1* | 9/2014 | Sheirs | A63D 5/10 15/98 |

* cited by examiner

AUTOMATIC METHOD FOR APPLYING NON-SLIP TREATMENT TO PIN DECK OF A BOWLING LANE

BACKGROUND OF THE INVENTION

Field of the Invention

The present invention relates to bowling lane maintenance machines and, more particularly, to the cleaning mechanism of such machines used to remove dirt, grime and old lane dressing from the surface of the lane before re-applying conditioning dressing thereto.

Description of the Prior Art

In the game of bowling a ball is rolled at an arrangement of bowling pins in order to knock them down and score points. The pins are arranged on a series of "spots" so that the pinsetting (or pinspotting) equipment can pick-up any pins left behind after the first roll of the ball and reset them for a second or spare shot. However, if a pin slides off the designated spot (referred to as an "out of range" pin), it can cause problems for the pinsetting equipment, and many times the dislocated pin(s) cannot be picked up and reset for a second attempt. This causes delays and dissatisfaction for bowlers as the pin(s) must be manually reset into place before the spare shot can occur. An out-of-range pin can also cause damage to the pinsetting equipment as it attempts to complete its cycle.

To reduce or eliminate sliding pins, different types of liquid pin deck treatments have been used, typically applied with some sort of spray bottle or pressurized sprayer with a wand (i.e. bug sprayer) to reach into the pin deck area. This method of application always results in the treatment covering more than just the area where it is needed (creating areas of contamination) and wasting product. It is also time-consuming and inconvenient to treat the pin decks in larger bowling centers. Since applying liquid treatments is very labor-intensive, the treatment does not get applied as frequently as needed, creating a problem with sliding pins.

Another method in use by bowling centers to help pins fall over rather than slide out of range has been to apply thin soft anti-skid plastic disks that adhere to each pin spot on the pin deck. A typical bowling center needs 10 disks per lane to cover the 10 spots on a triangular deck pattern—with the head pin (in front) designated as the 1-pin, the left rear pin being the 7-pin, and the right rear pin being the 10-pin. The disks covering the pin spots create an irregular surface that can make the pin deck more difficult to clean. In addition to being a more expensive method, if the disks are not properly applied and maintained they can cause the pins to fall over prematurely (i.e. when being placed on the spot by the pinsetting equipment).

Additionally, the typical composition of the pin deck surface has changed from finished hardwood (i.e. maple) to a synthetic material (i.e. phenolic laminate), creating a greater need for recurring pin deck treatments to reduce the out of ranges due to sliding pins on the slicker surface.

The present invention overcomes these problems by providing a new method and apparatus for applying liquid pin deck treatments in a consistent and automated fashion.

SUMMARY OF THE INVENTION

DETAILED DESCRIPTION OF THE PREFERRED EMBODIMENTS

Figure 1:
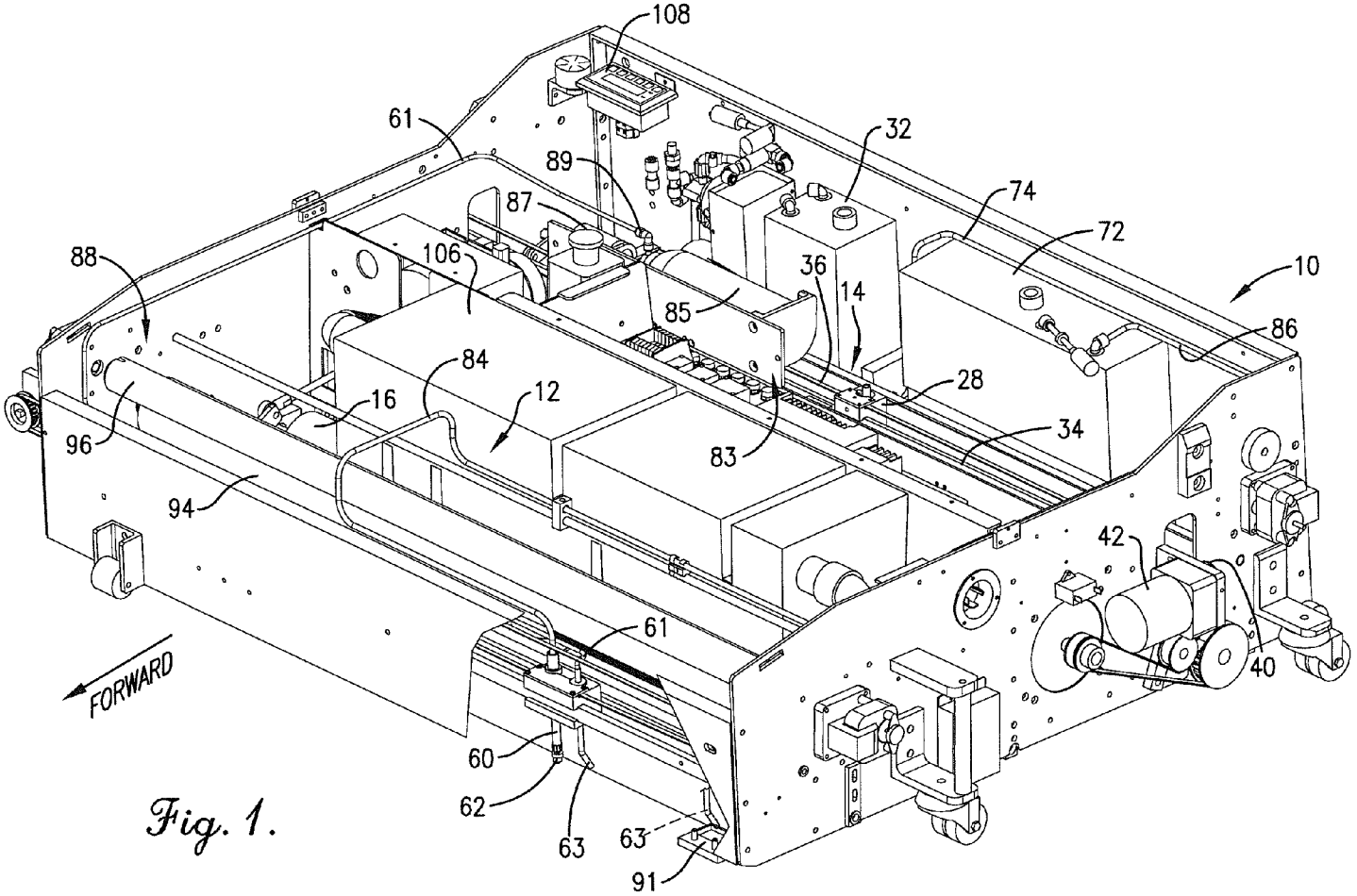
FIG. 1 is a left front perspective view of a maintenance machine embodying the principles of the present invention with its top cover removed to reveal internal details of construction.
Figure 2:
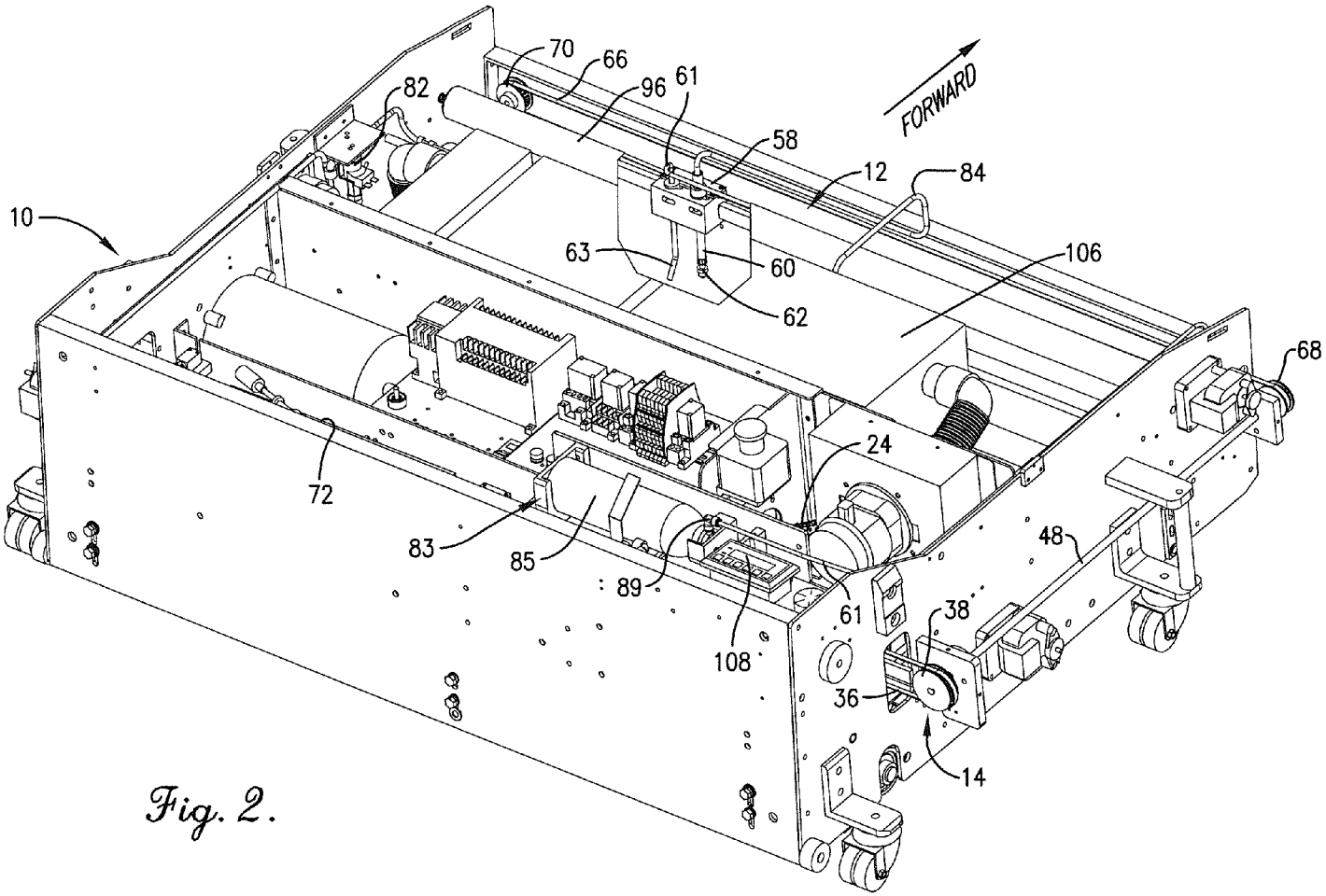
FIG. 2 is a right rear perspective view of the machine.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

The machine 10 illustrated in the drawings is similar in many respects to the machine disclosed in U.S. Pat. Nos. 5,729,855 and 7,060,137. Accordingly, the '855 and '137 patents are incorporated herein by reference. In view of the full disclosures in the '855 patent of the construction and operation of the lane machine, the construction and operation of the machine 10 will be described only generally herein.

The machine 10 has a cleaning system denoted broadly by the numeral 12 and located generally in the front of the machine. A dressing application system is denoted broadly by the numeral 14 and located generally in the rear portion of the machine. These two systems perform their functions as the machine travels up and down the lane through the provision of lane-engaging drive wheels 16 and 18 fixed to a transverse shaft 20 that is powered by a drive motor 22 and a chain and sprocket assembly 24.

The dressing application system 14 includes an applicator roll 26 disposed for engaging the lane surface, a reciprocating dressing dispensing head 28 that travels back and forth across the width of the lane above roll 26, and a brush assembly 30 between roll 26 and dispensing head 28 for receiving dressing from head 28 and delivering it to roll 26. Details of the construction and manner of use of brush assembly 30 are disclosed in U.S. Pat. No. 7,056,384, which is incorporated herein by reference. Dressing application system 14 additionally includes a reservoir 32 and a positive displacement pump (not shown) for supplying dressing from reservoir 32 to dispensing head 28.

Dressing dispensing head 28 is mounted for reciprocation along a transverse guide track 34 extending between the sidewalls of the machine. An endless drive belt 36 is secured to head 28 and has its opposite ends looped around a pair of pulleys 38 and 40, the pulley 40 being operably coupled with a reversible motor 42 to provide driving power to belt 36 and thus propel dispensing head 28 along track 34. A pair of sensors 44 and 46 adjacent opposite ends of the path of reciprocal travel of dispensing head 28 are operable to sense the presence of dispensing head 28 as it reaches one limit of its path of travel so as to signal the motor 42 to reverse directions and drive dispensing head 28 in the opposite direction along track 34.

Figure 3:
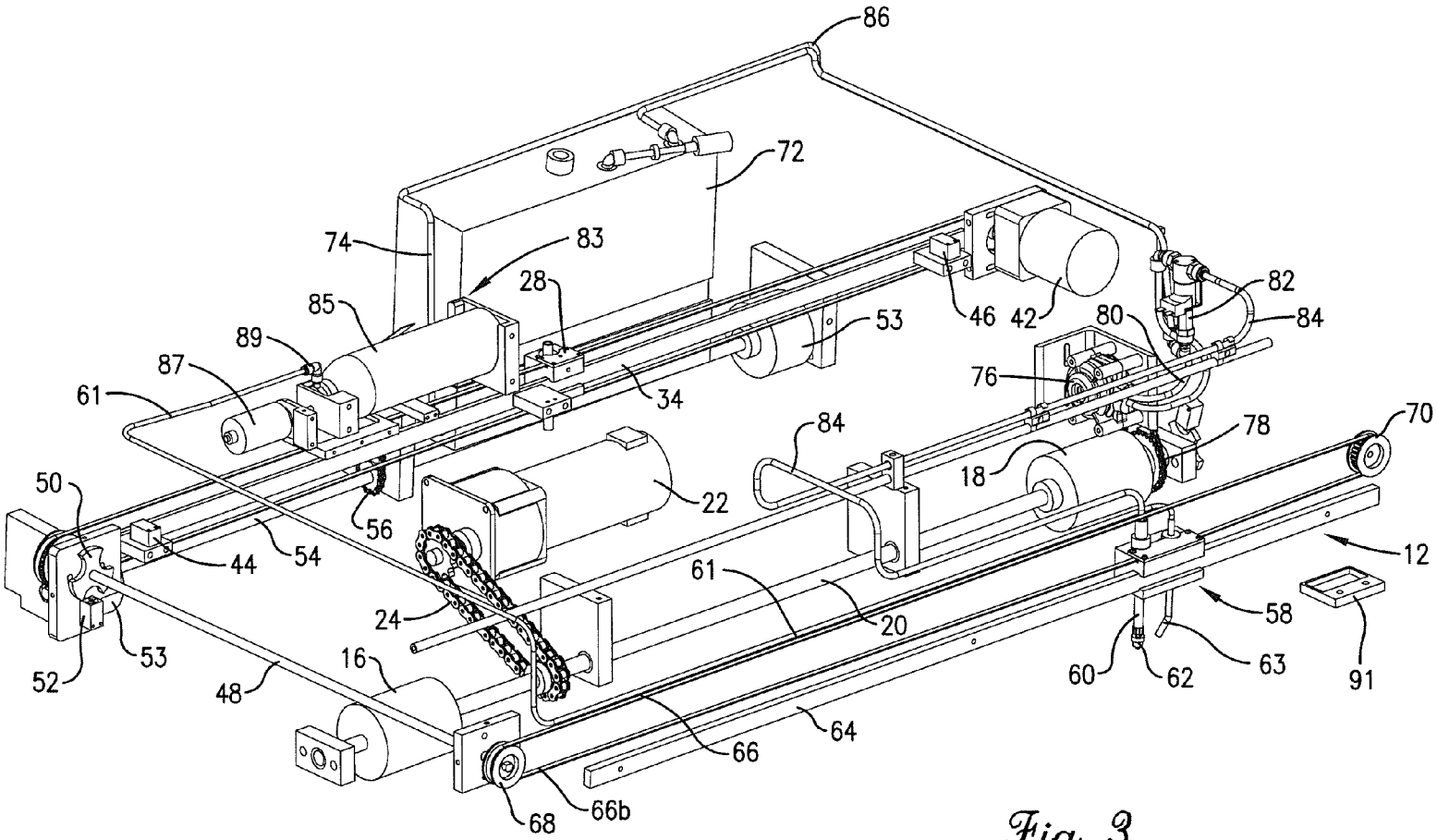
FIG. 3 is a right front perspective illustration of the cleaning system of the machine and its relationship to certain other components.
Figure 4:
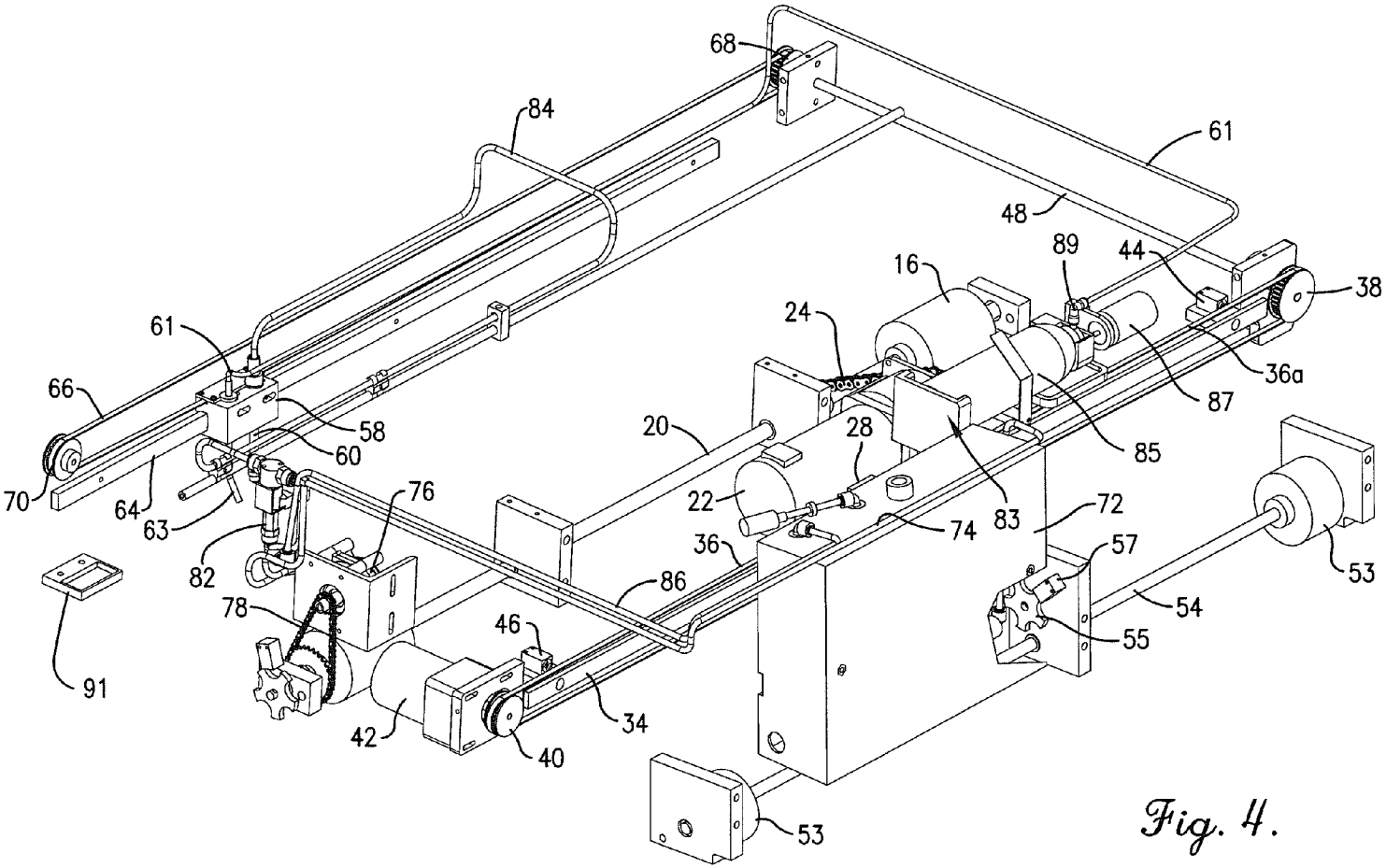
FIG. 4 is a left rear perspective illustration of the cleaning system and related components.
Figure 5:
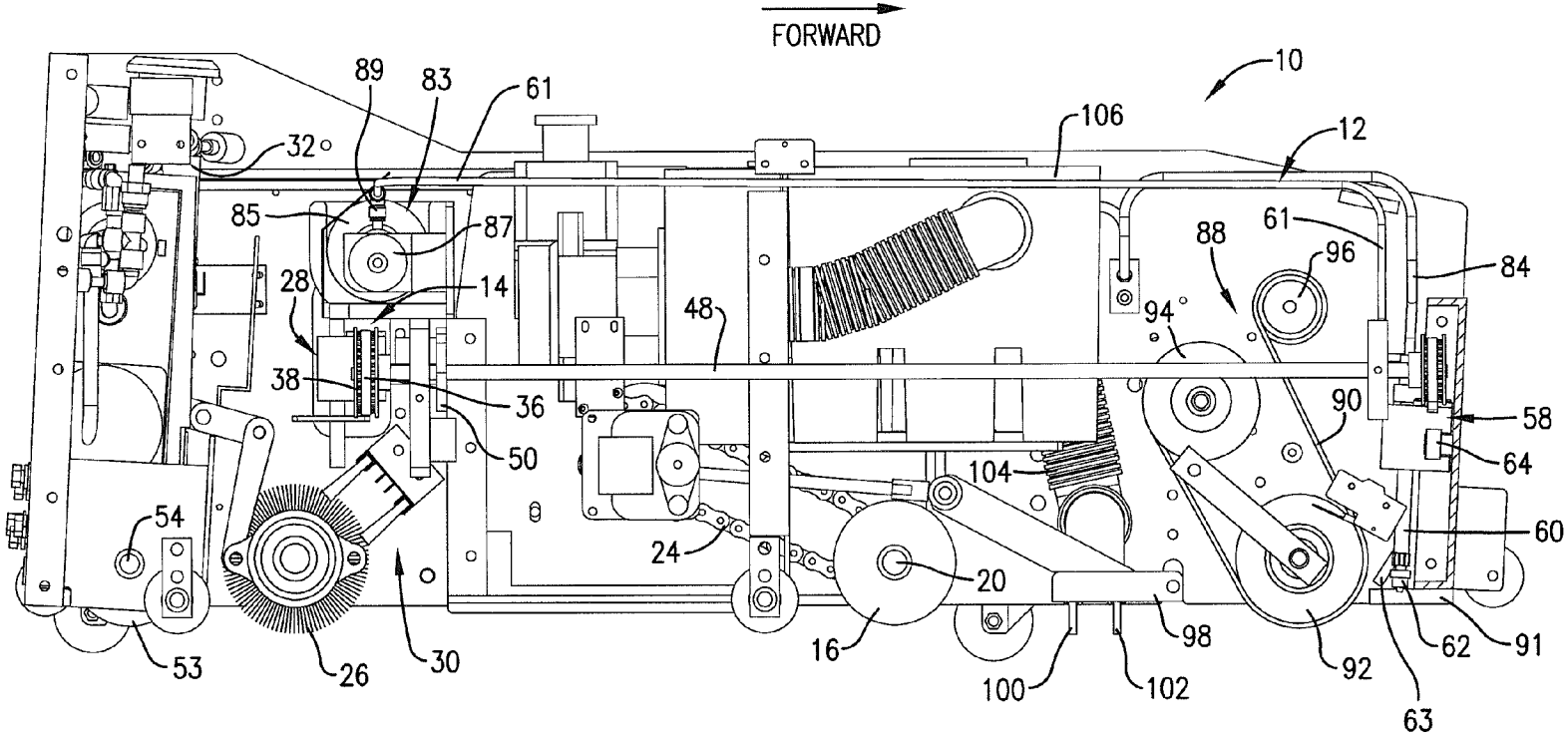
FIG. 5 is a right side elevational view of the machine with the near sidewall thereof removed to reveal internal details of construction.

The pulley 38 is fixed to a long fore-and-aft extending shaft 48 disposed just outboard of the right sidewall of the machine. Near its rear end, just forward of pulley 38, shaft 48 is provided with a notched wheel 50 whose rotation is sensed by a sensor 52. An output from sensor 52 may be sent to the control system of the machine (not shown) for the purpose of determining the precise location of the dressing dispensing head 28 across the width of the machine and the bowling lane. Such location is coordinated with a particular lane dressing pattern that has been programmed into the control system of the machine so that dressing dispensing head 28 may be actuated to precisely dispense dressing at predetermined locations along its path of reciprocation. Distance down the lane is determined by a pair of lane-engaging wheels 53 (FIGS. 3, 4 and 5) located just in front of the rear wall of the machine. Wheels 53 are fixed to a common cross shaft 54 that rotates a notched wheel 55 (FIG. 4) via a chain drive 56 (FIG. 3). The number of revolutions of notched wheel 55 is detected by a sensor 57 (FIG. 4) that sends a signal to the control system of the machine.

The cleaning system 12 includes one or more liquid dispensing head 58 that reciprocate across the path of travel of the machine as it moves along the lane. While system 12 may also include one or more pressurized spray nozzles as in conventional machines, in a preferred embodiment no such conventional spray nozzles are utilized. In the particular embodiment disclosed herein, only one dispensing head 58 is utilized, and in this instance, head 58 is a double head, designed to accommodate two dispensing or discharge tips, described further below. Such head 58 travels essentially the full transverse width of the machine to the same extent as the dressing dispensing head 28.

Dispensing head 58 includes two openings 59*a*, 59*b*. A vertically disposed, depending cleaning liquid discharge tube 60 provided with a dispensing or discharge tip 62 that is located close to the lane surface is positioned within opening 59*a*. In one form of the invention, tip 62 is not in the nature of an atomizing nozzle but is instead configured and arranged to emit liquid in a fairly coherent stream so that a bead of cleaning liquid is laid down on the lane surface. One suitable tip 62 for carrying out this particular non-atomizing function is available from the Value Plastics Company of Fort Collins, Colo. as part number VPS5401001N. Other types of tips (not shown) that atomize, breakup or diffuse liquid supplied to the tip may also be utilized where broader surface area coverage by the cleaning liquid is desired. In either case, tip 62 is preferably provided with an internal check valve (not shown).

Figure 6:
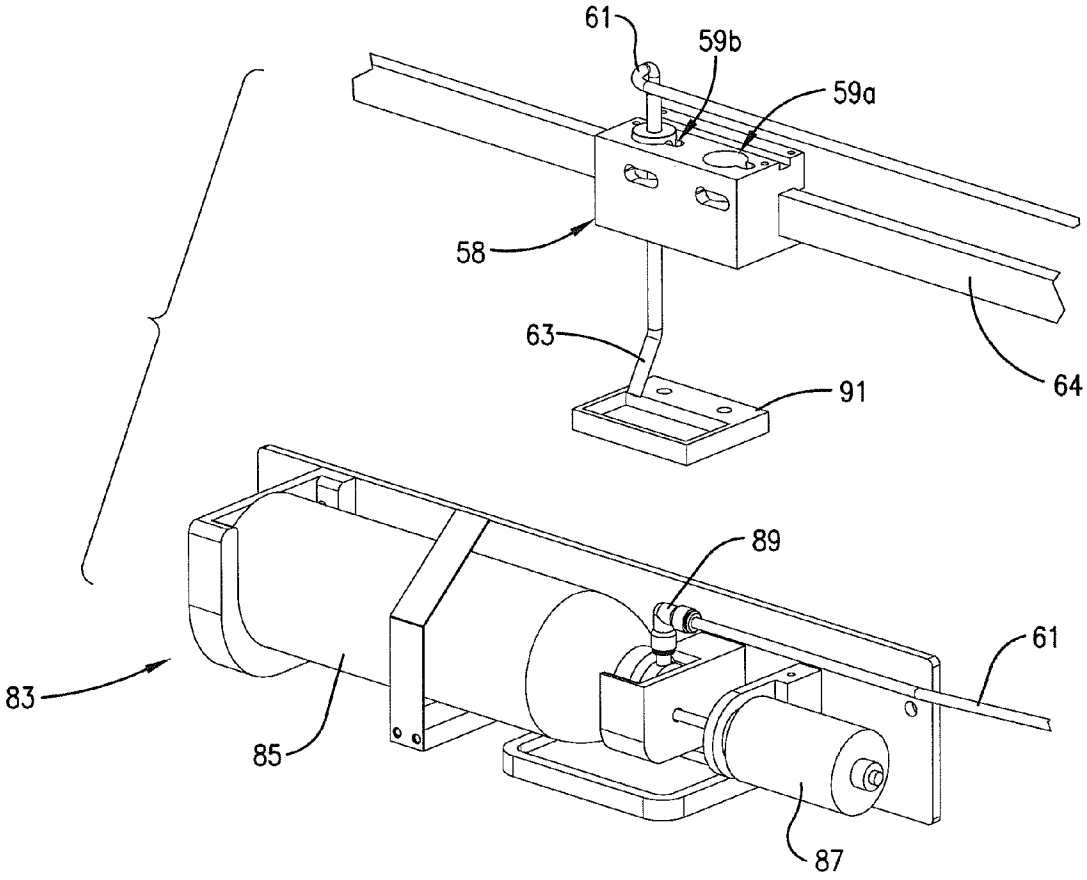
FIG. 6 is an illustration of the pin deck treatment system of the machine.

Opening 59*b* includes a pin deck treatment discharge tube 61 provided with a dispensing or discharge tip 63 that is located close to the lane surface, in a similar fashion to the positioning of tube 60 and tip 62 (FIG. 6). Additionally, tip 63 is similar in construction to tip 62. In a preferred embodiment, tip 63 is bent at an angle of from about 20° to about 40°, preferably from about 25° to about 35°, and more preferably about 30°, in order to more properly direct the pin deck treatment liquid, as described in more detail below. This bend has the advantage of preventing the pin deck treatment liquid from splattering against the pin deck surface and back onto the machine front panel (since pin deck treatment is carried out while the machine is in a stopped position). Additionally, this angle allows for mechanical adjustments, which can assist with centering the stream. Furthermore, because pin deck treatment liquids will tend to dry within tip 63, potentially causing clogging, it is preferred that tip 63 be provided with a removable cap (not shown) to seal the tip 63 (and tube 61) and prevent such clogging. A PLC program utilized for operating the machine can include a reminder to the operator to verify the tip is removed when the program calls for pin deck treatment liquid to be applied, as well as to remind the operator to replace the tip after application.

Cleaning system 12 further includes a guide track 64 attached to the front wall of machine 10 that slidably supports dispensing head 58 for its reciprocal movement. Track 64 extends across substantially the entire width of machine 10 to the same extent as the track 34 associated with dressing dispensing head 28. An endless drive belt 66 is attached to dispensing head 58 for providing reciprocal drive thereto, the belt 66 at its opposite ends being looped around a pair of pulley wheels 68 and 70 respectively.

Although pulley 68 may be driven in a number of different ways, including by its own separate drive motor, in a preferred form of the invention pulley 68 is fixed to the forwardmost end of shaft 48 from pulley 38 so that both dispensing heads 28 and 58 are driven by the same reversible motor 42. Consequently, both dressing dispensing head 28 and cleaning liquid/pin deck treatment dispensing head 58 are reciprocated simultaneously by motor 42 when the latter is actuated. However, it will be noted that dressing dispensing head 28 and cleaning liquid/pin deck treatment dispensing head 58 reciprocate in mutually opposite directions due to the fact that dressing dispensing head 28 is secured to the upper run 36*a* of its drive belt 36 while cleaning liquid/pin deck treatment dispensing head 58 is secured to the lower run 66*b* of its drive belt 66.

Cleaning system 12 further includes a cleaning solution reservoir 72 at the rear of machine 10. A supply line 74 leading from reservoir 72 is coupled in flow communication with a peristaltic pump 76 driven by a chain and sprocket assembly 78 operably coupled with the drive shaft 20 of lane drive wheels 16 and 18. When drive wheels 16 and 18 are turning, pump 76 is operating. It will be appreciated, however, that pump 76 could be driven by its own separate drive motor. An outlet line 80 from pump 76 leads to an inlet port of a solenoid-controlled valve 82 whose operation is controlled by the control system of machine 10. A supply line 84 leading from one outlet port of valve 82 communicates the valve 82 with discharge tube 60 of dispensing head 58, while a return line 86 communicates another outlet port of valve 82 with reservoir 72. Thus, depending upon the position of control valve 82, cleaning liquid may either be pumped to dispensing head 58 from reservoir 72 or by-passed back to reservoir 72 via return line 86. Because pump 76 is preferably a peristaltic pump, it supplies liquid to dispensing head 58 in constant volume slugs or squirts that enable the cleaning liquid to be very precisely and accurately metered onto the lane surface. Furthermore, it permits the supply of liquid to dispensing head 58 to be essentially instantaneously stopped and started, which, in conjunction with control valve 82, affords precise, board-by-board control over the pattern of cleaning liquid applied to the lane surface by dispensing head 58.

Cleaning system 12 further includes a pin deck treatment assembly 83 at the rear of machine 10. Pin deck treatment assembly 83 includes a pin deck treatment product can 85 operably connected to a trigger (push-pull) solenoid 87. Discharge tube 61 is connected to product can 85 via quick disconnect fitting 89, preferably at a "bag-on valve" in order to avoid product contamination. Product can 85 is preferably a replaceable aerosol can (typically with 14 ounces of capacity), with the pressure in the can used to propel the treatment liquid onto a lane surface when prompted to do so by solenoid 87. That is, solenoid 87 is controlled by a PLC program to open and close the valve. In a preferred embodiment, a drip tray 91 is included. In these embodiments, tips 62, 63 are positioned above drip tray 91 when in their "home" or non-working position, so that drip tray 91 catches any liquid that might drip from either of the tips 62, 63.

The preferred volume of product dispensed per lane should be from about 3 μL to about 7 μm. The volume can be controlled several ways, such as by controlling the amount of time the PLC opens the valve, by using an adjustable needle valve or specific tubing diameter, speed of the reciprocating head, and/or by incorporating different actuators that meter the volume. Some or all of these may be used in combination to control the amount of product that is dispensed per lane.

Any commercially available pin deck treatment compositions can be used with the present inventive method and equipment. One such composition is sold under the name Snowtack 765A by Lawter, Inc. In a preferred formulation, 30% by weight of the composition is mixed with 70% by weight water, and placed into an aerosol or otherwise pressurized can.

Cleaning system 12 additionally includes a wiping assembly 88 immediately behind cleaning liquid dispensing head 58. Assembly 88 includes a web 90 of soft material such as duster cloth looped around a lower compressible back-up member 92 in the nature of a roller that extends across the full width of the machine. Cloth 90 is stored on a roll 94 and is paid out at intervals selected by the operator and taken up by a takeup roll 96. Wiping assembly 88 is similar in principle to the corresponding wiping assembly disclosed in U.S. Pat. No. 6,615,434, hereby incorporated by reference into the present specification.

A further component of cleaning system 12 comprises a vacuum pickup head 98 located behind wiping assembly 88. Vacuum pickup head 98 extends essentially the full width of machine 10 and includes a pair of flexible, squeegee-type blades 100 and 102 that assist in picking up the thin film of cleaning liquid left on the lane surface after the wiping assembly 88 has acted upon the liquid. A large vacuum hose 104 leads from pickup head 98 to a holding tank 106 for storing liquid picked up by head 98. Vacuum pressure within holding tank 106 is obtained by means of a suction fan (not shown) coupled with tank 106.

Operation

In use, machine 10 is energized and controlled through the use of a user interface panel 108 located adjacent the right rear corner of the machine. Using interface panel 108, any one of a number of different patterns may be selected for applying cleaning liquid to the lane surface and for the application of dressing. Details of the oil pattern application using the dressing dispensing head 28 are described in the incorporated U.S. Pat. No. 5,729,855.

With respect to cleaning operations, as machine 10 travels along the lane surface the cleaning liquid dispensing head 58 reciprocates back and forth along its track 64 across the full width of the lane. Depending upon the distance down the lane as detected by the lane distance sensor 57 and the position of the dispensing head 58 across the width of the lane as detected by the transverse position sensor 52, control valve 82 allows cleaning liquid from constantly operating pump 76 to be squirted onto the lane surface through the outlet tube 60 and tip 62 of dispensing head 58. Although it is contemplated that dispensing head 58 may dispense cleaning liquid to the lane across the full width of the lane, it is also within the scope of the present invention to have cleaning liquid applied on a board-by-board basis for selective stripping or cleaning of the lane surface. The check valve (not shown) within tube 60 or tip 62 instantly closes the discharge path for cleaning liquid from head 58 when control valve 82 is shifted to a non-dispensing position. The check valve thus prevents leakage from dispensing head 58 during periods of non-use and provides a sharp demarcation between the presence and absence of cleaning liquid on the lane surface.

Cleaning liquid deposited by head 58 is immediately wiped into a thin film by cloth 90 looped around the backup roll 92 of wiping mechanism 88. While much of the liquid and oil and dirt are removed by cloth 90, a thin film remains, and this is engaged by the squeegees 100 and 102 of vacuum pickup head 98. Pickup head 98 thus lifts all remaining moisture, oil and grime from the lane surface and deposits it in the holding tank 106. As the rear of the machine passes over the cleaned region, the lane dressing is applied by applicator roll 26 in the pattern selected by the operator.

When the lane machine is programmed to start conditioning the bowling lanes, the operator will have the ability to either set a 7-day planner (to pre-program the desired days of the week to apply pin deck treatment) or choose to manually to apply the pin deck treatment for that particular operation. When using the lane machine of the '137 patent, the pin deck treatment can only be applied when operating that machine in the normal "Clean & Condition" mode or in "Clean Only" mode. As the lane machine moves in a forward motion, it will reach the end of the conditioner application distance and raise the buffer brush off the lane. When the input (in this example PLC Input 0.04) for the Brush Up Switch is closed, it will energize a relay to control two PLC outputs. One of the PLC outputs will be used to turn on and off the push-pull solenoid for the aerosol can triggering mechanism and the other changes the polarity of the power being sent to the Unwind Duster Motor (used for another feature).

As the machine enters the pin deck, it will slow and come to a stop when it has reached the programmed distance to the end of lane. Next, the machine will travel in reverse for a pre-set adjustable distance and stop, then it will energize the Duster Unwind Motor for a predetermined amount of time to lower the duster cloth onto the pin deck. The PLC will actuate the solenoid to open the valve on the pin deck treatment reservoir and apply a stream of pin deck treatment with the reciprocating head.

Once applied, the machine will begin traveling forward again for a pre-set adjustable distance to wipe or smear the solution onto the pin deck and then stop again. Typically, the machine will stop with the duster cloth at, or just behind, the rear row of pin spots. The Wind-Up Duster Motor will energize to wind up and lift the used cloth from the pin deck. Finally, the machine will travel in reverse and continue back to the foul line to finish its operation.

In one preferred embodiment, the machine will "park" both tips 62 and 63 over an absorbent pad (not shown) to collect any unwanted drips that might occur when the machine is traveling on the approach for either a walking or push machine. This prevents the discharge of the sticky pin deck treatment liquid onto the approach and ensures it is only deposited within the pin deck treatment area or zone.

In a preferred embodiment, a special function allows the machine to unwind more duster/cleaning cloth when the pin deck treatment option is selected. The amount of cloth used during this operation will be adjustable to eliminate the possibility of contaminating the cushion roller wrap or other parts of the cleaning system. When an operator chooses to enable the Pin Deck Treatment option, the Squeegee Wipe feature is turned off on the '137 machine, as well as other machines with that function.

It will be appreciated that the inventive pin deck treatment method and apparatus provide a number of advantages. For example, the entire process is automated and can be set as part of a routine schedule, making pin reset issues an unlikely occurrence. Additionally, the product stream is adjustable in width (lane boards covered from side to side) and length (longitudinal distance) via programming options in the PLC. Finally, using the reciprocating head and smearing the product with a duster cloth enables the machine to precisely apply the treatment to the desired areas of the pin deck and not anywhere else.

Although the above describes some of the preferred embodiments, it will be appreciated that variations can also be made while still being within the scope of the invention. For example, an alternate method for applying the pin deck treatment could be to use a separate reservoir, pump, and/or reciprocating head controlled by a PLC program to apply the treatment. This would require more components and an increased cost over the above description, but it may be useful in situations where a larger reservoir to store more product is desired.

Furthermore, as an alternative to the reciprocating head, the pin deck treatment could be sprayed onto the lane with one or more stationary spray nozzles as the machine exits the pinsetter. This method would be possible whether using an aerosol can or the separate reservoir and pump arrangement. Furthermore, rather than applying the pin deck treatment product directly to a pin deck, the product could be sprayed directly onto the duster cloth (or other membrane, pad, etc.) and then wiped onto the pin deck by the duster system in a similar pattern to the preferred method.

I claim:

1. A method of treating a bowling lane with a bowling lane maintenance machine comprising a cleaning system that includes a pin deck treatment assembly, the method comprising:

(a) moving the lane maintenance machine in a forward direction along the length of the bowling lane from a foul line to a pin deck;

(b) during at least a portion of the moving of step (a), dispensing a cleaning liquid from a cleaning solution reservoir of the cleaning system via a vertically disposed cleaning liquid discharge tube onto a surface of the bowling lane, wherein the cleaning liquid discharge tube depends from a dispensing head that reciprocates back and forth across the width of the bowling lane in a direction transverse to the path of travel of the lane maintenance machine while the cleaning liquid is being dispensed onto the surface of the bowling lane;

(c) during at least a portion of the dispensing of step (b), wiping the cleaning liquid deposited onto the surface of the bowling lane into a thin film using a cloth;

(d) subsequent to the wiping of step (c), stopping the lane maintenance machine at the pin deck;

(e) subsequent to said stopping of step (d), applying a pin deck treatment liquid onto at least a portion of a surface of the pin deck using the pin deck treatment assembly, wherein the applying includes reciprocating the dispensing head transversely along at least a portion of the pin deck surface and while the dispensing head is reciprocating, discharging the pin deck treatment liquid from a vertically disposed pin deck treatment tube depending from the dispensing head onto the pin deck surface or onto the cloth used during the wiping of step (c), wherein the pin deck treatment tube includes a discharge tip for discharging the pin deck treatment liquid onto the pin deck surface, wherein the discharge tip is bent at an angle of from about 20° to about 40° from the vertical, and wherein the machine remains stopped during the applying of step (e);

(f) subsequent to the applying of step (e), moving the lane maintenance machine forward across the pin deck and toward the end of the bowling lane;

(g) during at least a portion of the moving of step (f), smearing the pin deck treatment liquid on the surface of at least a portion of the pin deck using the cloth used during the wiping of step (c);

(h) stopping the machine near the end of the bowling lane so that the cloth is located at or just behind the rearmost row of pin spots in the pin deck;

(i) lifting the cloth from the pin deck surface using the lane maintenance machine; and (j) moving the lane maintenance machine in reverse from the pin deck to the foul line.

2. The method of claim 1, wherein the pin deck treatment liquid is discharged from the discharge tip of the pin deck treatment tube on the dispensing head in a stream.

3. The method of claim 1, wherein the pin deck treatment liquid is discharged from the discharge tip of the pin deck treatment tube on the dispensing head in a spray.

4. The method of claim 1, further comprising controlling the discharge of pin deck treatment liquid from the discharge tip of the pin deck treatment tube on the dispensing head in such a manner that pin deck treatment liquid is discharged at selected locations across the width of the pin deck surface.

5. The method of claim 4, wherein said controlling includes coordinating the discharge of pin deck treatment liquid at selected locations across the width of the pin deck surface with the distance of travel of the dispensing head along the length of the pin deck surface.

6. The method of claim 1, wherein said pin deck treatment liquid is dispensed from a pressurized can containing said pin deck treatment liquid.

7. The method of claim 1, wherein the discharge tip is bent at an angle of from about 25° to about 35° from the vertical.

8. The method of claim 1, wherein the dispensing of step (b) is controlled by opening and closing a first valve positioned on a cleaning liquid supply line connecting the cleaning solution reservoir to the cleaning liquid discharge tube and the applying of step (e) is controlled by opening and closing a second valve positioned on a pin deck treatment supply line connecting a pin deck treatment reservoir or a pressurized can of the pin deck treatment liquid and the pin deck treatment tube, wherein each of the first and said second valves are solenoid-controlled valves, and wherein the opening and closing of each of the first and second valves is controlled by a process logic control (PLC) program of an automated control system.

9. The method of claim 8, wherein the sequence of each of steps (a) through (j) is controlled by the PLC program.

10. The method of claim 1, subsequent to the wiping of step (c), removing the thin film of cleaning liquid from the surface of the bowling lane using at least one squeegee of a vacuum pickup head locate on the lane maintenance machine, wherein the operation of the squeegee is disabled during the smearing of step (g).

* * * * *